United States Patent [19]

Seachris

[11] Patent Number: 4,910,497

[45] Date of Patent: Mar. 20, 1990

[54] CLOSURE ALARM FOR CONTAINMENT CHAMBERS FOR DANGEROUS MATERIALS

[76] Inventor: Harlan E. Seachris, E. 2017 Sinto Ave., Spokane, Wash. 99202

[21] Appl. No.: 217,619

[22] Filed: Jul. 11, 1988

[51] Int. Cl.[4] ..... G08B 13/08

[52] U.S. Cl. ..... 340/545; 340/693

[58] Field of Search ..... 340/528, 546, 545, 693

[56] References Cited

U.S. PATENT DOCUMENTS

| | | | |
|---|---|---|---|
| 1,080,464 | 12/1913 | Larsen . | |
| 1,305,190 | 5/1919 | Bobo . | |
| 1,562,574 | 11/1925 | Maud . | |
| 3,266,029 | 8/1966 | Callahan . | |
| 3,378,830 | 4/1968 | Patrick . | |
| 3,710,371 | 1/1973 | Whalen et al. . | |
| 3,797,006 | 3/1974 | Reininger | 340/545 |
| 3,852,737 | 12/1974 | Gordon . | |
| 3,866,201 | 2/1975 | Betswenger | 340/528 |
| 3,932,856 | 1/1976 | Tremont . | |
| 4,052,718 | 10/1977 | Tucci et al. . | |
| 4,117,465 | 9/1978 | Timblin | 340/545 |
| 4,194,193 | 3/1980 | McDonough | 340/545 |
| 4,264,899 | 4/1981 | Menzies et al. | 340/545 |
| 4,438,428 | 3/1984 | Ober | 340/521 |
| 4,528,558 | 7/1985 | Steers et al. | 340/545 |
| 4,617,556 | 10/1986 | Rivera et al. | 340/545 |
| 4,688,023 | 8/1987 | McGill | 340/545 |

*Primary Examiner*—Joseph A. Orsino
*Assistant Examiner*—Frank M. Scutch, III
*Attorney, Agent, or Firm*—Keith S. Bergman

[57] ABSTRACT

An alarm device is disclosed to indicate the opening of an access element of a containment chamber carrying dangerous materials, such as a drawer or cupboard door, by children or similar intellectually unsophisticated persons. The alarm device provides two switches that are sequentially activated by a pivotally movable, externally projecting, wedge shaped sensor that moves outwardly to cause alarm annunciation at, or at a predetermined time after activation, if not deactivated by further outward manual motion before or after alarm annunciation. The alarm device is battery powered and operated by solid state electronic circuitry that is contained in a small compact casement that serves as a mounting means.

5 Claims, 2 Drawing Sheets

CLOSURE ALARM FOR CONTAINMENT CHAMBERS FOR DANGEROUS MATERIALS

BACKGROUND OF INVENTION

RELATED APPLICATIONS

There are no applications related heretofore filed in this or any foreign country.

FIELD OF INVENTION

My invention relates generally to self-contained audible alarm devices to annunciate opening of containment chambers but allow deactivation by sophisticated operators.

BACKGROUND AND DESCRIPTION OF PRIOR ART

With the advance and sophistication of modern culture, it has become almost a societal necessity to maintain in household environments various deleterious substances which may be poisonous or otherwise destructive of the normal biological functioning of humans. Such substances present ever present hazards to any human, but these hazards are especially enhanced for humans of limited mental capacity and intellectual sophistication, such as children, the mentally handicapped or persons in altered states of consciousness.

Publicly available statistics indicate that in the year last past there were approximately five million calls to poison centers and of these, over three million involved children under age five. Approximately ninety-four percent of these calls emanate from a household environment and historically the number of such occurrences is increasing. My invention is directed particularly toward preventing poisonings in younger children, though secondarily it is quite operative with other persons having similarly unsophisticated educational background or limited mental ability.

One solution to accidental happenings with dangerous materials has been directed toward provision of some sort of a closure or sealing device for a primary container that most immediately contains the poisonous material. These solutions have been more or less effective, but they create new problems of their own. Such devices generally make authorized and desired usage of a protected product difficult, especially by persons having physical incapacity such as the aged, persons who are ill or injured and oftentimes ordinary people who just do not know or understand how a particular device operates. Because of these factors, various safety devices associated with the primary or immediate poison container have inherent limitations and in the case of pharmaceuticals and medicinals these limitations may be quite serious in preventing persons from gaining access to a product when necessary. The instant invention seeks to alleviate this type of problem.

Commonly, poisonous substances either are or may be maintained in a secondary containment space that requires opening of a movable closure element for access, such as a drawer or cupboard. This opening function may be utilized to audibly annunciate to others within the vicinity the opening of such containment space. The instant invention seeks to provide a particular improved device for so doing that is especially adapted to warn of such access by unsophisticated persons of limited mental ability and experience.

Various entry alarm devices have heretofore become known, but most have been associated with structural openings through which a person's ingress and egress is had, rather than with the opening of containment structures for smaller articles. These known entry alarms generally have not provided any means for disablement, as this would tend to defeat their purpose of annunciating entry by a sophisticated person. My alarm device in contradistinction senses opening of a container and audibly annunciates that occurrence either immediately or after a delay period. During the delay period or thereafter, the sensing means may be operated by a sufficiently sophisticated person to annul the initial activating event and cancel annunciation that did or would potentially result therefrom, as when entry be desired for use of the materials in a container by an appropriate person.

The actuator mechanism of my alarm provides a novel pivotally mounted wedge shaped element that is biased to an outward position projecting from a casement, but pivotal inwardly within the casement to sense two separate outward positions, whereat switching means are sequentially operated to responsively activate annunciation and optionally annul annunciation after activation. This actuator structure allows the initiation of the annunciation cycle by the first switch means automatically by reason of its bias and annulment by the second switch means upon further appropriate manual manipulation by a sophisticated user. The structure is such that an unsophisticated user would not generally comprehend or accidentally procure the deactivation of the alarm once it has been activated.

The actuator is automatically movable within a channel defined in the casement when in a null or unarmed state, and is so positioned when a chamber opening structure be closed, but is moved outwardly to its biased outward position by its biasing means when the opening structure is opened. Prior art opening alarm devices in contradistinction have generally provided an actuator that sense only the single condition of opening a containment space, and may be manually turned off even when a containment space being serviced is closed.

My casement structure is relatively small and universally mountable in different orientations in a container, but yet contains all mechanism of the alarm device in distinguishment from alarm devices that require specialized reformation of containers or portions of containers in which they are installed.

Though my alarm device is intended primarily for cabinets, cupboards or drawers where poisonous substances may be maintained, it may serve a similar purpose of annunciating opening by unsophisticated persons of other closures where entry might be harmful to them or otherwise undesirable. This is particularly true of kitchen drawers where knives or similar implements may be contained, gun cabinets where guns, ammunition or explosives may be maintained, jewelry cases where smaller expensive items may be maintained, and other similar areas.

My invention is distinguished from the prior art not in any one of these individual features per se, but rather in the synergistic combination of all of its particular structures that give rise to the functions necessarily flowing therefrom as hereinafter more particularly specified and claimed.

SUMMARY OF INVENTION

My invention generally provides a rigid casement having mounting means and pivotally supporting a two position switch actuator biased to a first outward manual position and movable to a second further outward position. The casement contains battery powering means and electronic circuitry intercommunicating through multiple switch means to an annunciator to audibly annunciate particular actuator position. The casement is mounted in a closure so that when the access means of that closure is opened or closed, the actuator moves responsively to sequentially operate the electronic switch means. The alarm is activated to annunciate at or at a predetermined time after the actuator moves to a first outward position, and deactivated at a second outward actuator position. This allows annunciation of container opening, but yet allows an appropriate person to deactivate the alarm by actuator motion prior to or during annunciation.

In providing such an alarm device, it is:

A principal object of my invention to provide a small compact self-contained alarm that may be mounted within a secondary containment space to indicate the opening of access means to that space by intellectually unsophisticated persons not knowing how to deactivate the alarm.

A further object of my invention is to provide such a device that has switch actuator means to activate alarm annunciation either at or after a predetermined delay period when in a first position, and to deactivate the alarm when in a second position.

A further object of my invention is to provide such switch actuator means that provides a pivotally mounted, wedge shaped actuator biased to a first position projecting at an angle from the casement and manually movable outwardly to a second angular position to cause switching functions in a necessary sequential order.

A still further object of my invention is to provide such an alarm device that is operable with any type of secondary containment enclosure to which access is gained by movement of an opening element, such as a hinged door, drawer, sliding door, removable cover, or the like.

A still further object of my invention is to provide such an alarm device that is battery powered and is of solid state electrical circuitry for substantial reliability and low maintenance.

A still further object of my invention is to provide such an alarm device that is of a fail safe nature and that has no switch by which it may be accidentally deactivated after closure.

A still further object of my invention is to provide such a device that is of new and novel design, of rugged and durable nature, of simple and economic manufacture and one otherwise well suited to the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being illustrated in the accompanying drawings as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

My invention generally comprises casement 10 pivotally mounting outwardly extending switch actuator 11 and containing electrical circuitry 12 having switching means to annunciate an audible alarm responsive to particular switch actuator positions.

Figure 1:
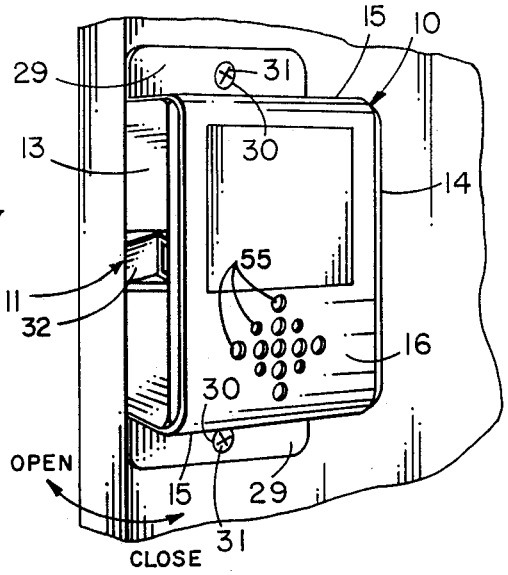
FIG. 1 is an isometric view of my alarm device mounted on a hinged door to show various of its parts, their configuration and relationship.
Figure 2:
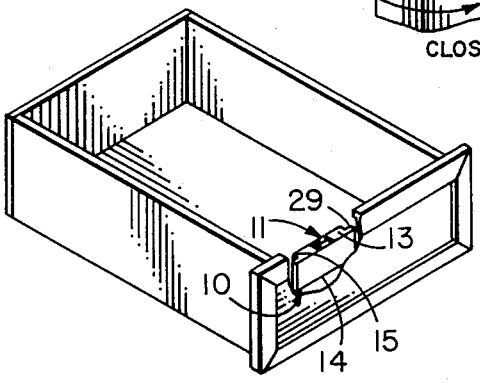
FIG. 2 is a partially cutaway isometric view showing my alarm device mounted in an operative position on a slidably movable drawer.

Casement 10 is a peripherally defined, semi-rigid, somewhat resilient container of rectilinear configuration with rounded edges, illustrated particularly in FIGS. 1 and 2. The casement defines separate body portion **10*a* and removable cover portion 10*b***.

Body **10*a* is formed with elongate outer side 13 and inner side 14 interconnected with similar ends 15 to form a rectangle with face edges which on one side structurally communicate with face 16. The medial portion of body 10*a* is divided by septum 17, extending between ends 15, and provided with ledges 18 at a spaced distance outwardly from the septum to provide means for holding an electronic circuitry board (not shown) in the interior of the device and to add some additional strength and rigidity to the casement. If necessary or desired, holes 55** may be defined in the peripheral casement surface to better allow sound waves generated by the annunciator to pass from the casement structure.

Similar spaced actuator support walls 22 extend inwardly from outer side 13 of the casement to the outward facing surface of adjacent ledge 18 to define a channel for an actuator support therebetween. Each of these fastening legs define similar spaced cooperating actuator fastening ears 23 defining slots **23*a* that journal lateral axles of an actuator mechanism. Back 10*b*, when positioned on the casement, locks the journaling elements of the actuator in slots 23*a*** in the fastening ears.

Figure 3:
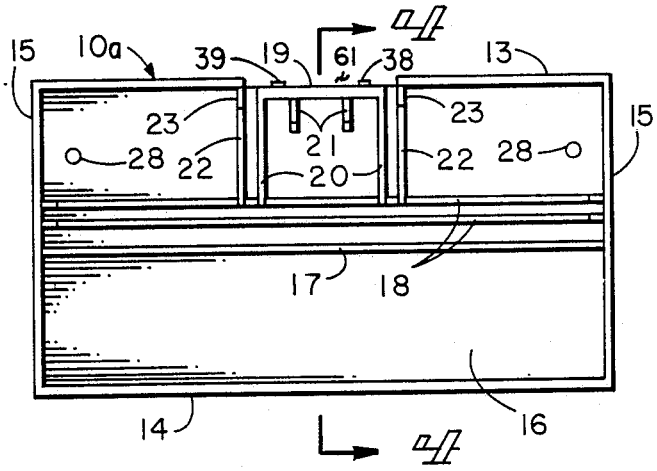
FIG. 3 is an orthographic back view (looking forwardly) of the casement of my alarm device, with the back structure removed to show internal construction.
Figure 4:
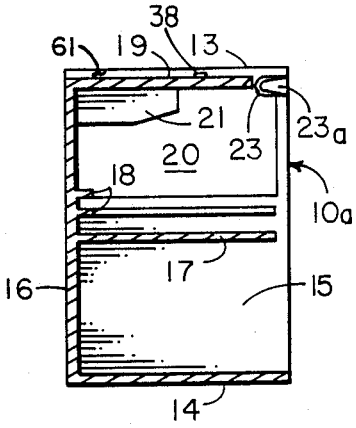
FIG. 4 is a vertical cross-sectional view of the casement structure of FIG. 3, taken on the line 4—4 thereon in the direction indicated by the arrows.
Figure 5:
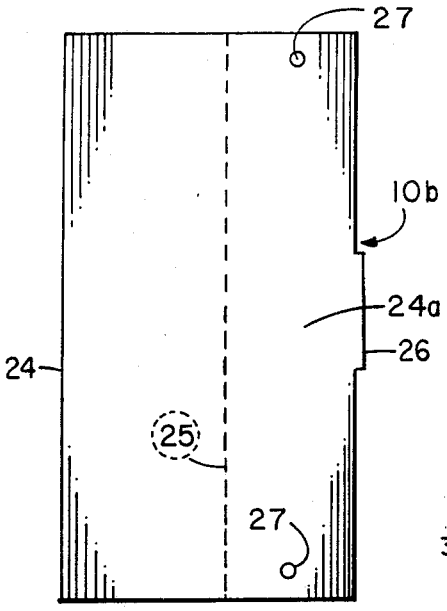
FIG. 5 is an orthographic surface view of the back closure member of my invention.
Figure 6:
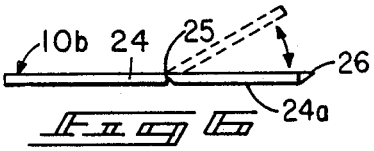
FIG. 6 is an orthographic end view of the back closure member of FIG. 5, showing the relative motion of its operable element.

Actuator support structure is defined in the outer portion of the casement body between support walls 22. This structure, as seen especially in FIGS. 3 and 4, provides actuator support surface 19 supported on similar spaced opposed legs 20 both extending between face 16 and back **10*b* of the casement so that the legs may be structurally interconnected to face 16 and rest immediately inwardly adjacent back 10*b* when that member be positioned on the casement body. The actuator support legs 20 are each positioned spacedly inwardly of the adjacent support walls 22 to create spaces between these elements to receive side elements 33 of an actuator. The outer surface of support 19 is a spaced distance inwardly from the plane of the outer surface of outer side 13 to provide channel 61 wherein switch actuator element 11 is carried when in its null inward position. Fillets 21 structurally communicate between the inwardly facing surfaces of face 16 and support 19** to provide additional strength and rigidity for the actuator support surface.

Back **10*b* provides planar back element 24 of appropriate size and configuration to cover the opening defined by sides 13, 14 and ends 15. The back element is divided on its inner surface by elongate "V" shaped groove 25 which creates a hinge that allows foldable motion of the portions on either side of that groove relative to each other. Openable door portion 24*a* allows access to the chamber defined between septum 17 and inner side 14 of the casement where battery powering means are carried to allow access for battery placement and change when necessary. Openable portion 24*a* of the back is provided with tab 26** extending beyond its periphery to aid manual manipulation of that portion as required for opening.

The casement structure is formed of reasonably rigid durable material that still has some resiliency to allow it to serve its purposes. The material of preference is one of the harder, more dense polymeric or resinous plastics commonly available and heretofore used for such purposes. The material must have appropriate resilience to allow deformation of opening part **24*a*** of the back member and preferably should have reasonable resistance to impact, tearing, bending, cracking and similar deteriorating actions to provide appropriate durability. With plastic material, the casement body and cover are preferably formed by injection molding and if so, the various parts described will be structurally joined in the course of formation. The structure may, however, be formed by assembling individual elements and if so, the mechanical joinder of adjacent surfaces of various elements to each other is accomplished according to methods commonly and traditionally used for such materials in the past.

The joinder of back **10*b* to body 10*a* of the casement may be releasable or permanent as desired. If a permanent joinder be desired, the cover portion that does not open is structurally joined where its adjacent surfaces communicate with body 10*a***. If a releasable joinder of this element be desired, appropriate protuberances and indentations (not shown) as heretofore commonly used in the plastic forming arts for such purposes are provided. Since in normal positioning, the openable back portion will be immediately adjacent some structural element of a secondary container carrying the alarm device, permanent joinder of the back normally is not necessary though it may be desirable to make installation and use of the device more convenient and simple.

Figure 7:
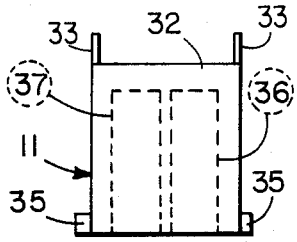
FIG. 7 is an orthographic top view of the switch actuator of my alarm device.
Figure 9:
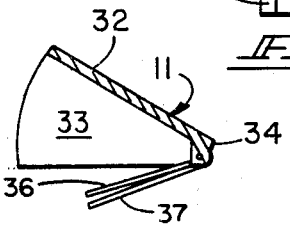
FIG. 9 is a vertical cross-sectional view of the switch actuator of FIG. 8, taken on the line 9—9 thereon in the direction indicated by the arrows.
Figure 8:
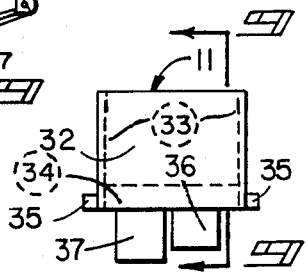
FIG. 8 is an orthographic end view of the switch actuator of FIG. 7.

Actuator 11 is shown particularly in the illustrations of FIGS. 7, 8, and 9 where it is seen to comprise sheet-like top element 32 structurally intercommunicating with similar depending side elements 33 and mounting element 34. The mounting element provides similar axles 35, extending a spaced distance laterally beyond each side element, to provide means for pivotal mounting of the actuator in slots **23*a* of the fastening ears of the actuator support. Two elongate switch arms 36, 37 extend outwardly from the medial portion of mounting element 34, in the same direction as planar top 32 but in an angulated relationship to each other, as illustrated particularly in FIG. 9. The switch arms are formed of an elastically resilient material so that when the outer portions of these elements rest on some solid surface such as the actuator support, they will bias top 32** away from that surface but allow its motion toward it against their bias.

The outer surface of actuator support surface 19 carries two spaced switches 38 and 39 positioned to contact respectively bottom switch arms 36 and the upper switch arm 37 to cooperatively form operative switch means. The switches 38, 39 are of a pressure sensitive micro type, normally closed by pressure from switch arms 36, 37 and openable upon appropriate release of such pressure. It is to be noted that the switch arms will necessarily contact their associated switches in sequential order, that order depending upon the direction of actuator motion.

The actuator member is dimensioned and configured to fit over actuator support surface 19 of the casement member and within actuator slot 61 defined in the casement, with its axles 35 journaled in fastening ears 23. With this structure then, the actuator element normally will rest in a first relaxed position extending outwardly at an angle from casement 10, but may pivotally move, with the application of appropriate force, to a second outward position and a third inward position immediately adjacent the outer surface of actuator support 19.

Means for fastening the alarm device within a chamber defined by a secondary containment space must be provided. This may be variously accomplished according to known methods heretofore used for such purposes. A plurality of cooperating pairs of holes 27 in opposed casement walls, so defined that they or fasteners therein, will not interfere with the internal structure of the device, may be provided in the casement itself to allow insertions of screws, bolts or similar elongate fasteners therethrough and into or through the peripheral surface defining a secondary container chamber for fastening to that surface. In the form of device illustrated in FIGS. 1 and 2, flanges 28 are provided to structurally communicate with the casement and define fastener holes 29 to accept screw fasteners 30 to fasten and positionally maintain the casement. Other methods of fastening might provide appropriate bracket structures, separable from the casement, that may be fastened to a surface defining a containment chamber; interlocking fastening devices of various sorts having portions carried by both the container surface and the casement of my alarm; double sided adhesive tapes; or other similar fastening means. The method by which the casement is fastened within a container to be protected is not critical so long as the fastening maintains proper positioning of my alarm device and is reasonably durable.

Figure 10:
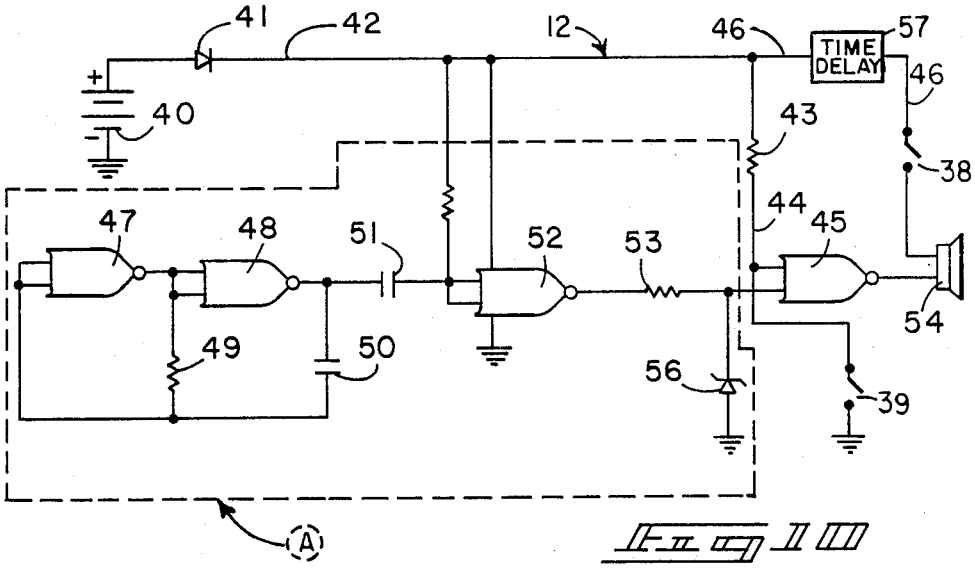
FIG. 10 is an electric diagram showing a typical solid state electrical circuit for my alarm device.

A typical electrical circuit for use with my invention is shown in the illustration of FIG. 10. The exact circuitry is not particularly critical to my invention, the circuitry illustrated is not remarkable, and various other circuits may perform the same functions.

In the illustration, battery powering source 40 is negatively grounded and communicates from its positive pole through diode 41 to power supply line 42 which communicates with the various circuit elements. This line communicates through resistor 43 and line 44 to diode gate 45 which upon attainment of proper state allows passage of current to annunciator 54. Positive voltage supplied through line 46, time delay 57 if used, and activator switch 39 to the other pole of annunciator 54. Line 44 also communicates through switch 38 to ground to provide current to annunciator 54 when gate 45 be in appropriate state. This circuitry will pass current through annunciator 54 when switch 38 is open and switch 39 is closed; when the latter switch is opened, no current will flow through the annunciator whatever the state of switch 38. A time delay is provided by diode gate 57, if used, to operate the annunciator only at a predetermined period after closing of switch 38 to allow deactivation by the second switching means 39 before any annunciation.

The circuitry enclosed in the dashed box labeled "A" is an oscillator circuit to test and annunciate a low battery condition in the device. The two diode gates 47, 48 and resistor 49 and capacitor 50 form the oscillator proper. The output of this oscillatory circuit is coupled by capacitor 51, diode gate 52 and resistor 53 to annunciator diode gate 45. If the battery potential in this circuit falls below a predetermined value, current will flow through the circuit to present an oscillating signal to annunciator gate 45 to there cause a periodic signal to annunciate the low battery condition.

Having described the structure of my invention, its operation may be understood.

Firstly, an alarm device is formed according to the foregoing specification. The device is attached within a chamber of a secondary containment space in a position to sense the open condition of an opening element that allows access to that space. In the illustration of FIG. 1, the device is attached to the inside of a hingeably supported door and in the illustration of FIG. 2 it is attached to the inside of the front panel of a slidably movable drawer. In either instance, the attachment is such that activator 11 moves to its first biased outward annunciating position when the carrying structure be opened for access to the container, but moves to its inward null third position when the orifice closing element of the containment space is in closed position. Casement 10 will be mounted with its outer side 13 substantially parallel to one of the edges of the orifice closing element so that activator 11 will project angularly from outer side 13 in assuming its outwardly biased position. The casement is positioned so that the apex of the angle between the casement and the outer surface of the activator faces in the direction toward which the container closing element is moved in closing the containment structure. This positioning aids the orifice closing element in automatically moving the activator inwardly into its null position in activator slot 23.

With my alarm so positioned, it is ready for operation. After the device is installed as aforesaid, the opening element of a containment space being serviced is closed. Actuator 11 is thereby moved to its inward third position with top element 32 resting spacedly adjacent actuator support surface 19 of the casement and within actuator slot 23. In this position, both switch 36, 38 and switch 37, 39 will be in their normal closed condition to set the electronic circuitry to a null mode. The device will remain in this null mode so long as the secondary containment structure remains closed and no current will pass in the annunciating circuitry, so long as the battery has normal output voltage.

When the opening element of the containment space is moved to an open position, switch 38 will open to allow current to pass through annunciator 54 and gate 45, and if no further action occurs with switch 39, that current will activate annunciator 54 after a predetermined delay to cause audible annunciation. If, however, switch 39 is activated, current will not pass through line 46 to activate the annunciation process. Switch 38 is operated by the inner switch actuator element so that switch must necessarily be the first to be activated by reason of the physical structure of the actuator element. Switch 39 is represented by the outer switch activator element so that if, after opening the opening element of the containment space, the actuator element be manually pulled out by an operator to its second outer position, this will open switch 39 and prevent current from passing through the annunciator to cause audible annunciation. A time delay provided by delay device 54 allows operation of the annunciator only at a predetermined time after activation of switch 38, to provide opportunity for deactivation of the device before any annunciation, if desired. If the delay device be omitted, annunciation will immediately occur upon actuation of switch 39.

A certain amount of intellectual sophistication is required to know and understand the nature of operation of my alarm device to allow a person opening a containment space to deactivate the alarm. Such sophistication is generally not possessed by children of tender years and such children will not be able to deactivate the device by the essence of their nature. This also is true of some persons suffering various mental and physical disabilities, though the causation may be somewhat different. My alarm device therefore will allow the opening of a closure space without annunciation of an alarm signal or immediately after that annunciation, as the case may be, if the user have appropriate mental sophistication and act properly to use it, but not otherwise.

It is to be noted from the foregoing description that my alarm device is fail-safe in the sense that it provides no means by which the device can be physically turned off without immediate manual attention after container opening and does not provide any structure which would generally allow application of external mechanical means to maintain the actuator in a null or off state without manual attention or closing of an associated containment space.

It is further to be noted that my alarm device is universally applicable to ordinary secondary containment structures that have opening members that open and close to allow access to the containment chamber thereof. My alarm device may be variously mounted and positioned to be functionable in a particular instance, but such mounting is very simple in any ordinary containment structure, be it a hinged door cupboard, a pull-out drawer, a sliding door, or whatever.

It should further be noted that the physical switching devices of my invention are of a particular nature that require switch operation in sequential order so that the deactivating switch may not be activated before the activating switch. This prevents accidental operation of the device that might disrupt its normal function to cause appropriate activation or deactivation, again to provide a fail-safe type operation.

The foregoing description of my invention is necessarily of a detailed nature so that a specific embodiment of it might be set forth as required, but it is to be understood that various modifications of detail, rearrangement and multiplication of parts may be resorted to without departing from its spirit, essence or scope.

Having thusly described my invention, what I desire to protect by Letters Patent, and

What I claim is:

1. An alarm device to audibly annunciate the opening of an opening element of a secondary containment space for dangerous materials, comprising, in combination:

a casement having a back substantially perpendicular to an adjacent first outer side, said first outer side defining an actuator support and an actuator channel to receive an actuator without projection beyond the first outer side and allow actuator motion outwardly of said first outer side, and said casement further having means for pivotally mounting an actuator in said actuator channel and means for mounting the casement with its back adjacent a surface defining the secondary containment space;

an actuator carried by the casement in the actuator channel adjacent the actuator support to pivot from the casement to first and second outward positions and means for biasing the actuator to the first outward position, said actuator having first and second switch means for operation at the first and second actuator positions respectively; and electrical circuitry carried within the casement providing a powering source for an audio annunciator activated by said first switch means and deactivated by said second switch means.

2. The invention of claim 1 carried within a containment space, defined by a container having an opening element for access, in a position wherein the actuator is maintained in a null inward third position when the opening element is closed but is moved by its bias to the first outward position to operate the first switch means when the opening element is opened.

3. The invention of claim 1 wherein the electric circuitry is of a solid state nature, powered by a battery power source carried within the casement and has means of annunciating battery condition by sensing battery output below a predetermined level.

4. An alarm device to indicate the opening of a containment space, for the containment of dangerous materials, which has an opening element that moves to allow access to the containment space, comprising, in combination:

a peripherally defined casement having means for attachment to a structural element defining a containment chamber and means for pivotal attachment of an actuator, said casement defining an actuator support structure and an actuator channel to carry an actuator within the actuator channel for motion outwardly therefrom;

an actuator pivotally carried by the casement for motion outwardly from the channel of to the actuator support, said actuator being biased to a first position and being manually movable to a second position both said first and second positions being outward of the periphery of the casement and said actuator having first and second switch operating means at said first and second outward actuator positions respectively; and electrical circuitry carried within the casement including battery means powering an audible annunciator, first switching means to operate the annunciator responsive to the first switch operating means and second switch means to cancel operation of the annunciator responsive to the second switch operating means.

5. The apparatus of claim 4 carried by the structure defining a containment space and within that containment space during its closure, the said apparatus being so positioned that the actuator is maintained in a third inward null position in the actuator support channel when the opening element of the containment space is closed but is movable by its bias to the first outward position when the opening element is opened.

* * * * *